US011211731B2

(12) United States Patent
Oosaka

(10) Patent No.: US 11,211,731 B2
(45) Date of Patent: Dec. 28, 2021

(54) ELECTRICAL CONNECTOR PREVENTING ABRASION OF A LOCKING PROTRUSION

(71) Applicant: JAPAN AVIATION ELECTRONICS INDUSTRY, LIMITED, Tokyo (JP)

(72) Inventor: Junji Oosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/738,462

(22) Filed: Jan. 9, 2020

(65) Prior Publication Data

US 2020/0313331 A1 Oct. 1, 2020

(30) Foreign Application Priority Data

Mar. 26, 2019 (JP) ..... JP2019-057607

(51) Int. Cl.
*H01R 13/20* (2006.01)
*H01R 13/26* (2006.01)

(52) U.S. Cl.
CPC ..... *H01R 13/20* (2013.01); *H01R 13/26* (2013.01)

(58) Field of Classification Search
CPC ..... H01R 13/20; H01R 13/26; H01R 3/06
USPC ..... 439/655
See application file for complete search history.

(56) References Cited

U.S. PATENT DOCUMENTS 9,300,095 B2 * 3/2016 Lin ..... H01R 13/6585
9,450,337 B2 * 9/2016 Kao ..... H01R 13/6461
9,680,254 B1 * 6/2017 Nishikata ..... H01R 13/41
9,843,148 B2 * 12/2017 Little ..... H01R 24/60
9,853,404 B2 * 12/2017 Zhao ..... H01R 24/60
9,917,405 B2 * 3/2018 Ju ..... H01R 13/6583
9,997,853 B2 * 6/2018 Little ..... H01R 13/6471
(Continued)

FOREIGN PATENT DOCUMENTS

CN 204304072 U 4/2015
CN 206211128 U 5/2017
(Continued)

OTHER PUBLICATIONS

Taiwanese Office Action (and English language translation thereof) dated Nov. 9, 2020 issued in counterpart Taiwanese Application No. 108147190.

(Continued)

*Primary Examiner* — Peter G Leigh
(74) *Attorney, Agent, or Firm* — Holtz, Holtz & Volek PC

(57) ABSTRACT

A connector is mateable with a mating connector along a predetermined direction. The mating connector comprises a mating lock portion. The connector comprises at least a connector main. The connector main comprises a holding member, a plurality of contacts and two lock portions. The contacts are held by the holding member. Each of the lock portions has a held portion and a spring portion. The held portion is held by the holding member. The spring portion is resiliently deformable. The spring portion has a locking protrusion and a resilient supporting portion. The locking protrusion and the mating lock portion lock a mated state where the connector and the mating connector are mated with each other. The connector main has a space which is positioned inward in a first direction beyond the spring portion. The space allows resilient deformation of the spring portion.

13 Claims, 11 Drawing Sheets

(56) References Cited

U.S. PATENT DOCUMENTS

| | | | | |
|---|---|---|---|---|
| 10,116,098 | B2 * | 10/2018 | Zhao | H01R 24/60 |
| 10,170,863 | B2 * | 1/2019 | Qiu | H01R 13/6585 |
| 10,411,412 | B2 | 9/2019 | Chu | |
| 2013/0330976 | A1 | 12/2013 | Simmel et al. | |
| 2015/0044886 | A1 * | 2/2015 | Little | H01R 13/6582 439/55 |
| 2015/0295362 | A1 * | 10/2015 | Tziviskos | H01R 13/6581 439/607.01 |
| 2017/0352968 | A1 * | 12/2017 | Zhang | H01R 24/60 |
| 2017/0373442 | A1 * | 12/2017 | Qiu | H01R 24/60 |
| 2018/0006408 | A1 * | 1/2018 | Wen | H01R 24/62 |
| 2018/0076581 | A1 * | 3/2018 | Tsai | H01R 24/60 |
| 2018/0138642 | A1 * | 5/2018 | Kong | H01R 13/652 |
| 2018/0191102 | A1 * | 7/2018 | Arai | H01R 24/60 |
| 2019/0044287 | A1 * | 2/2019 | Lin | H01R 13/502 |
| 2019/0131748 | A1 * | 5/2019 | Cheng | H01R 13/6597 |

FOREIGN PATENT DOCUMENTS

| | | | |
|---|---|---|---|
| JP | 2017098052 | A | 6/2017 |
| TW | M541138 | U | 5/2017 |
| TW | M549975 | U | 10/2017 |
| TW | M553061 | U | 12/2017 |
| TW | M556418 | U | 3/2018 |

OTHER PUBLICATIONS

Chinese Office Action (and English language translation thereof) dated Mar. 26, 2021 issued in counterpart Chinese Application No. 202010076608.8.

* cited by examiner

ELECTRICAL CONNECTOR PREVENTING ABRASION OF A LOCKING PROTRUSION

CROSS REFERENCE TO RELATED APPLICATIONS

This application is based on and claims priority under 35 U.S.C. § 119 to Japanese Patent Application No. JP2019-057607 filed Mar. 26, 2019, the contents of which are incorporated herein in their entireties by reference.

BACKGROUND OF THE INVENTION

This invention relates to a connector which comprises a connector main with a lock portion.

JPA2017-98052 (Patent Document 1) discloses a connector 900 of this type. As shown in FIGS. 20 and 21, the connector 900 of Patent Document 1 is mateable with a mating connector 950 along an X-direction. The mating connector 950 has mating lock portions 952. The connector 900 comprises a connector main 910. The connector main 910 comprises a holding member 920, a plurality of contacts (not shown) and two multifunction plates 925. Each of the multifunction plates 925 is formed by punching out a metal plate, followed by bending it. Each of the multifunction plates 925 has a lock portion 930. The lock portion 930 has a held portion 932 and a spring portion 936. The held portion 932 is held by the holding member 920. The spring portion 936 extends in the X-direction from the held portion 932. The spring portion 936 has a locking protrusion 937 and a resilient supporting portion 939. The locking protrusion 937 and the mating lock portion 952 are configured to lock a mated state where the connector 900 and the mating connector 950 are mated with each other. The locking protrusion 937 protrudes outward in a Y-direction. The resilient supporting portion 939 is resiliently deformable and supports the locking protrusion 937. The connector main 910 has spaces 940 which correspond to the resilient supporting portions 939, respectively. Each of the spaces 940 is positioned inward of the corresponding resilient supporting portion 939 in the Y-direction. Each of the spaces 940 allows resilient deformation of the corresponding resilient supporting portion 939.

The connector 900 is configured so that the resilient supporting portion 939 is resiliently deformed inward in the Y-direction in accordance with force applied to the locking protrusion 937. This configuration enables the connector 900 to have a reduced frictional force between the locking protrusion 937 of the connector 900 and the mating lock portion 952 of the mating connector 950 upon the mating of the connector 900 with the mating connector 950 or removal thereof therefrom in comparison with an assumption where the resilient supporting portion 939 be undeformable.

As described above, the multifunction plate 925 of the connector 900 is formed by punching out a metal plate, followed by bending it. Thus, an outer surface of the locking protrusion 937 of the connector 900 is a rough, broken face. Accordingly, if a process, which includes the mating of the connector 900 with the mating connector 950 and the removal thereof therefrom, is repetitively performed, the locking protrusion 937 of the connector 900 might be repeatedly brought into contact with the mating lock portion 952 of the mating connector 950 to be abraded.

SUMMARY OF THE INVENTION

It is therefore an object of the present invention to provide a connector preventing abrasion of a locking protrusion even if a process, which includes mating of the connector with a mating connector and removal thereof therefrom, is repetitively performed.

One aspect of the present invention provides a connector mateable with a mating connector along a predetermined direction. The mating connector comprises a mating lock portion. The connector comprises at least a connector main. The connector main comprises a holding member, a plurality of contacts and two lock portions. The holding member has a plate-like portion. The contacts are held by the holding member. Each of the contacts has a contact portion. On the plate-like portion, the contact portions are arranged in a first direction perpendicular to the predetermined direction. The contact portions are exposed on the plate-like portion in a second direction perpendicular to both the predetermined direction and the first direction. Each of the lock portions has a held portion and a spring portion. The held portion is held by the holding member. The spring portion is resiliently deformable. The spring portion extends from the held portion in the predetermined direction. The spring portion has a predetermined size in the second direction. The spring portion has a predetermined thickness in a plane perpendicular to the second direction. The predetermined size is greater than the predetermined thickness. The spring portion has a locking protrusion and a resilient supporting portion. The locking protrusion protrudes outward in the first direction. The locking protrusion and the mating lock portion lock a mated state where the connector and the mating connector are mated with each other. The resilient supporting portion supports the locking protrusion. The connector main has a space which is positioned inward in the first direction beyond the spring portion. The space allows resilient deformation of the spring portion.

The connector of the present invention is configured as follows: the spring portion has the predetermined size in the second direction while having the predetermined thickness in the plane perpendicular to the second direction; and the predetermined size is greater than the predetermined thickness. This configuration prevents abrasion of the locking protrusion even if a process, which includes the mating of the connector with the mating connector and removal thereof therefrom, is repetitively performed.

An appreciation of the objectives of the present invention and a more complete understanding of its structure may be had by studying the following description of the preferred embodiment and by referring to the accompanying drawings.

Figure 1:
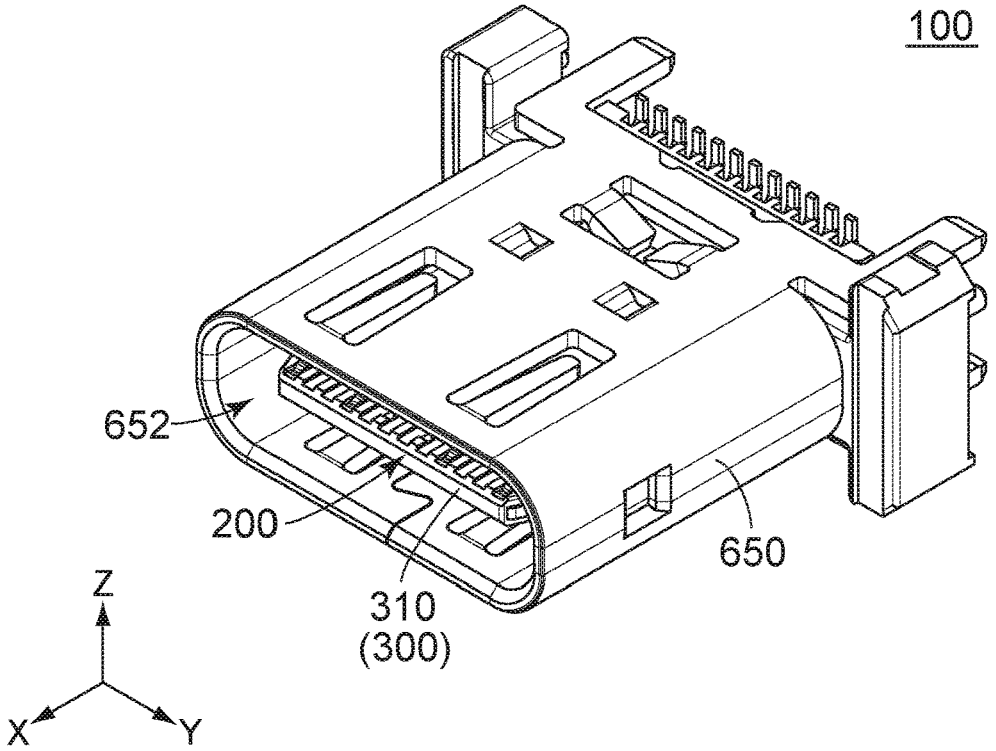
FIG. 1 is a perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 7:
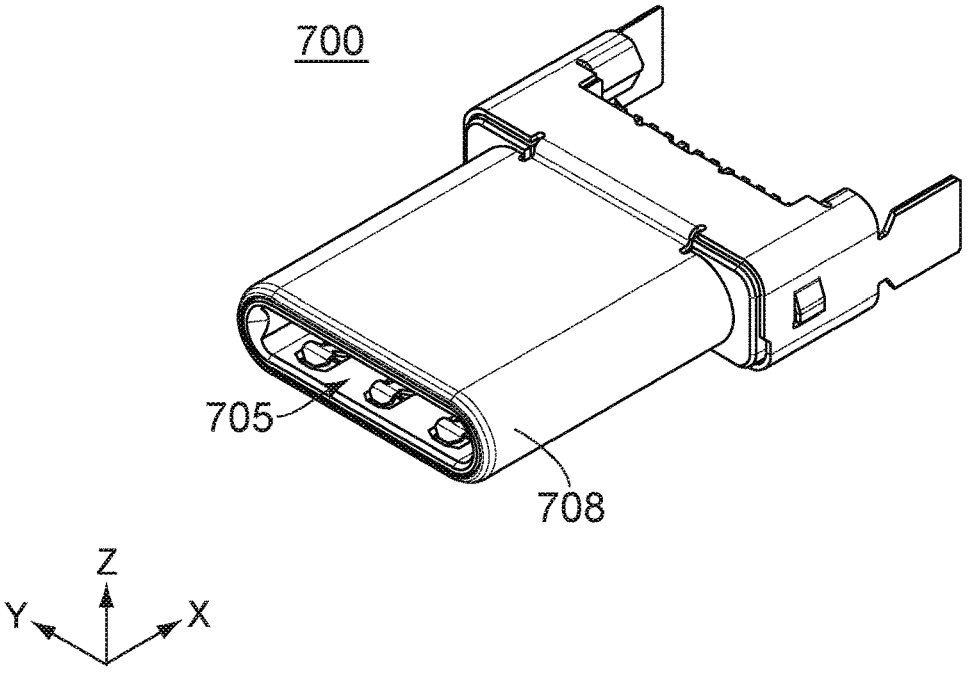
FIG. 7 is a perspective view showing a mating connector according to the first embodiment of the present invention.

Referring to FIGS. 1 and 7, a connector 100 according to a first embodiment of the present invention is mateable with a mating connector 700 along a predetermined direction. In the present embodiment, the predetermined direction is a front-rear direction. In the figure, the front-rear direction is shown as an X-direction. It is assumed that forward is a positive X-direction while rearward is a negative X-direction.

Figure 9:
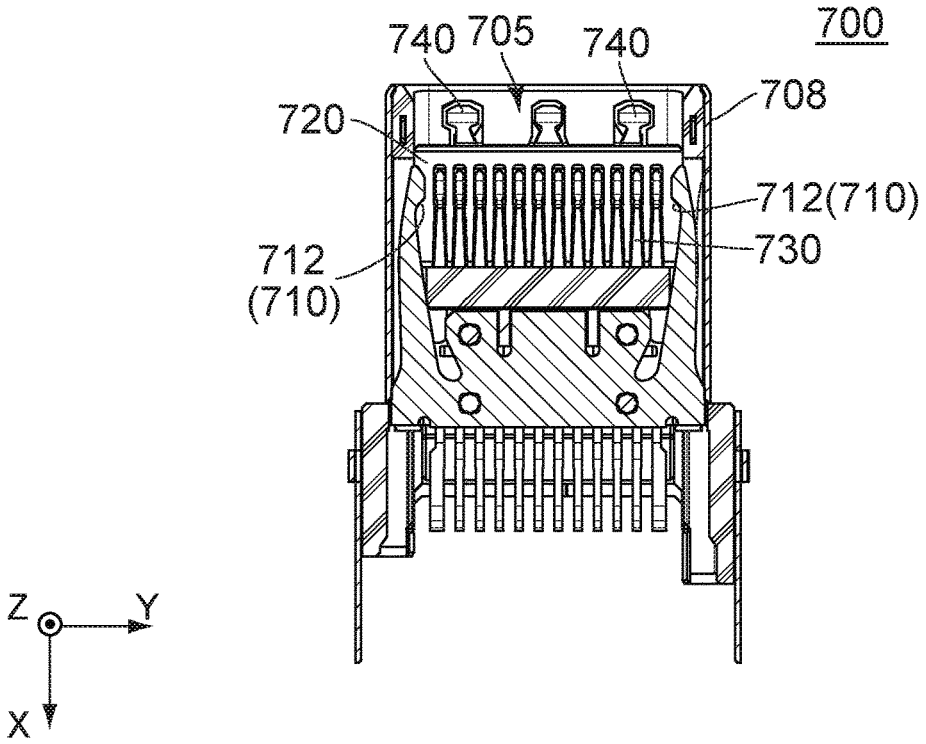
FIG. 9 is a cross-sectional view showing the mating connector of FIG. 8, taken along line A-A

As shown in FIG. 9, the mating connector 700 has a mating accommodation portion 705, a mating fitting portion 708, a mating holding member 720, mating lock portions 710, mating contacts 730 and ground springs 740.

Figure 8:
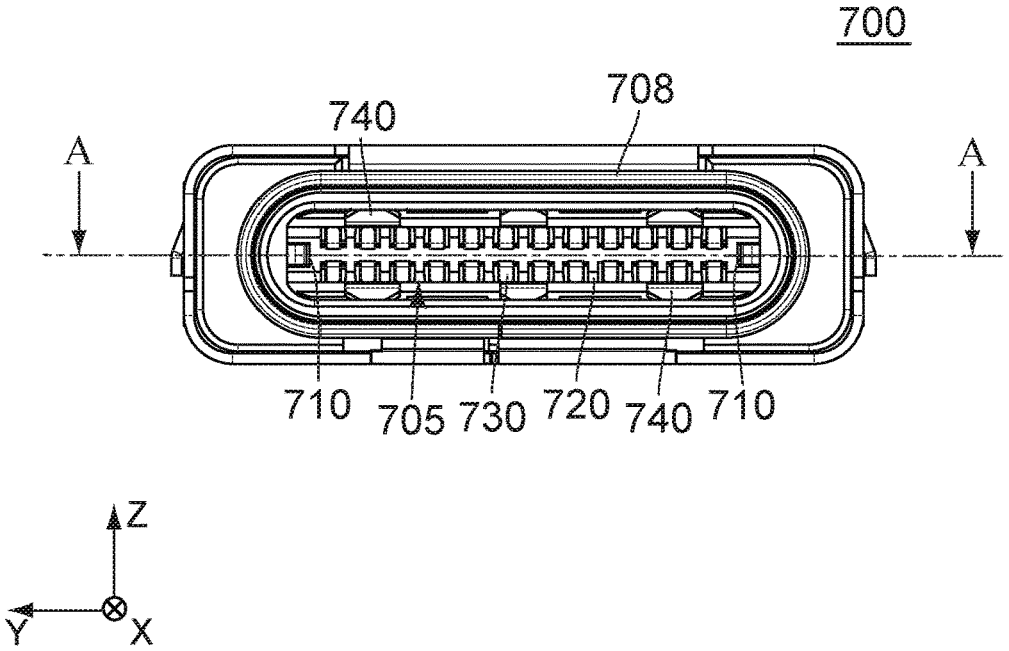
FIG. 8 is a front view showing the mating connector of FIG. 7.

As shown in FIGS. 8 and 9, the mating accommodation portion 705 of the present embodiment is a space which opens at its rear end and which extends in the front-rear direction.

As shown in FIG. 9, the mating fitting portion 708 of the present embodiment is positioned at a rear end of the mating connector 700 in the front-rear direction. As shown in FIG. 8, the mating fitting portion 708 surrounds the mating accommodation portion 705 in a plane perpendicular to the front-rear direction.

Referring to FIG. 8, the mating holding member 720 of the present embodiment is made of insulator.

As shown in FIG. 9, the mating lock portions 710 of the present embodiment are held by the mating holding member 720. Each of the mating lock portions 710 has a mating lock surface 712.

Referring to FIG. 9, each of the mating contacts 730 of the present embodiment is made of metal. The mating contacts 730 are held by the mating holding member 720. As shown in FIG. 8, each of the mating contacts 730 protrudes in the mating accommodation portion 705.

Referring to FIG. 9, each of the ground springs 740 of the present embodiment is made of metal. The ground springs 740 are held by the mating holding member 720. As shown in FIG. 8, each of the ground springs 740 protrudes in the mating accommodation portion 705.

As shown in FIG. 1, the connector 100 of the present embodiment has a connector main 200 and a shell 650. However, the present invention is not limited thereto. The connector 100 may be modified, provided that the connector 100 comprises at least the connector main 200.

Figure 2:
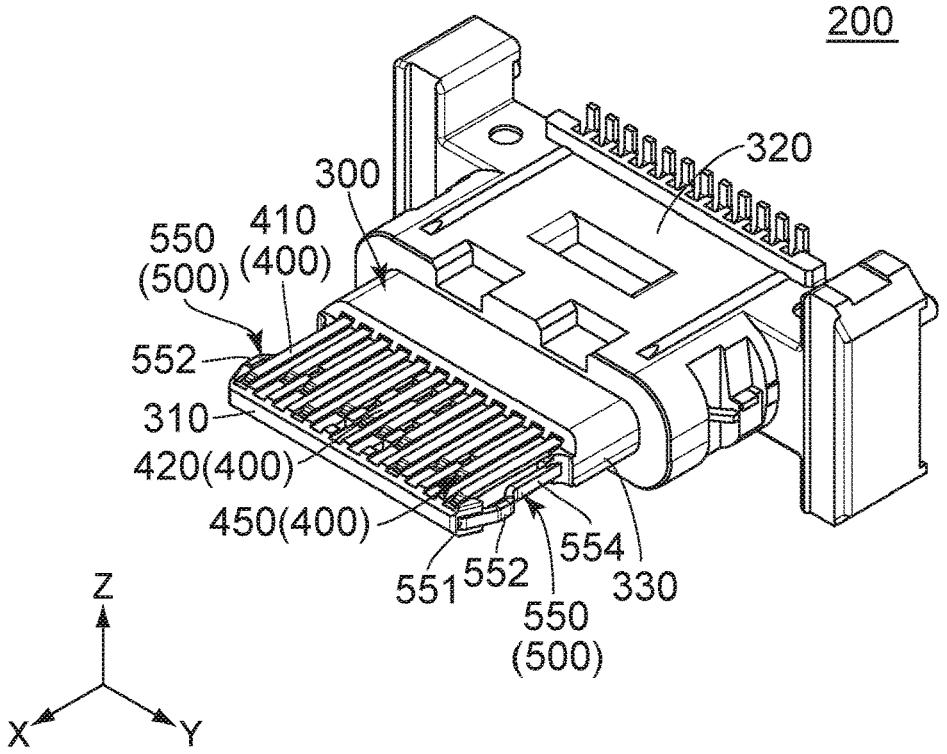
FIG. 2 is a perspective view showing a connector main which is included in the connector of FIG. 1.
Figure 3:
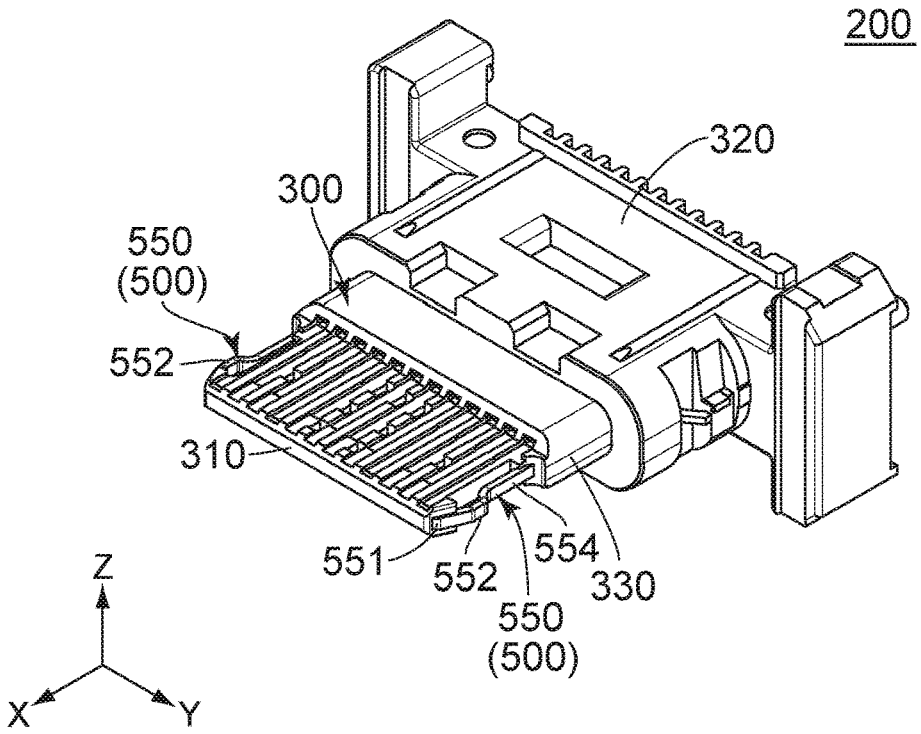
FIG. 3 is another perspective view showing the connector main of FIG. 2. In the figure, contacts are omitted.
Figure 5:
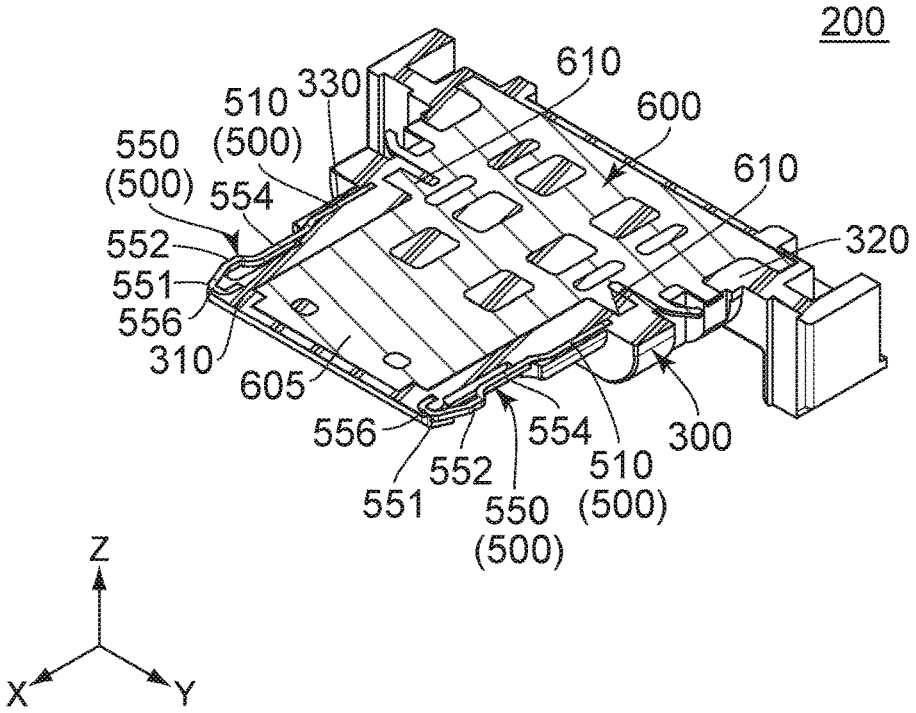
FIG. 5 is a perspective, cross-sectional view showing the connector main of FIG. 2.

As shown in FIGS. 2 and 5, the connector main 200 of the present embodiment comprises a holding member 300, a plurality of contacts 400, a midplate 600 and two lock portions 500.

Referring to FIG. 2, the holding member 300 of the present embodiment is made of insulator. The holding member 300 has a plate-like portion 310, a middle portion 330 and a base portion 320.

As shown in FIG. 2, the plate-like portion 310 of the present embodiment has a flat plate shape extending in a plane which is defined by the front-rear direction and a first direction perpendicular to the front-rear direction. In the present embodiment, the first direction is a right-left direction. In the figure, the right-left direction is shown as a Y-direction. The plate-like portion 310 is accommodated in the mating accommodation portion 705 when the connector 100 is mated with the mating connector 700.

As shown in FIG. 2, the middle portion 330 of the present embodiment is positioned between the plate-like portion 310 and the base portion 320 in the front-rear direction, or in the predetermined direction. The middle portion 330 is positioned rearward of the plate-like portion 310 in the front-rear direction. The middle portion 330 is positioned forward of the base portion 320 in the front-rear direction. The middle portion 330 has an outer circumference which is greater than the plate-like portion 310 in a direction perpendicular to the front-rear direction. The middle portion 330 is accommodated in the mating accommodation portion 705 when the connector 100 is mated with the mating connector 700.

As shown in FIG. 2, the base portion 320 of the present embodiment defines a rear end of the connector main 200 in the front-rear direction. The base portion 320 has an outer circumference which is greater than the middle portion 330 in the direction perpendicular to the front-rear direction.

As shown in FIG. 2, the contacts 400 of the present embodiment are held by the holding member 300. Referring to FIG. 2, the contacts 400 of the present embodiment form two contact rows 450. The contacts 400 of each of the contact rows 450 are arranged in the right-left direction, or in the first direction. The two contact rows 450 are arranged apart from each other in a second direction which is perpendicular to both the front-rear direction and the right-left direction. In other words, the two contact rows 450 are arranged apart from each other in the second direction which is perpendicular to both the predetermined direction and the first direction. In the present embodiment, the second direction is an up-down direction. In the figure, the up-down direction is shown as a Z-direction. Specifically, it is assumed that upward is a positive Z-direction while downward is a negative Z-direction. The plurality of contacts 400 includes a plurality of ground terminals 410. However, the present invention is not limited thereto. The plurality of contacts 400 may be modified, provided that the plurality of contacts 400 includes at least one ground terminal 410.

Referring to FIG. 2, each of the contacts 400 is made of conductor. Each of the contacts 400 has a contact portion 420. On the plate-like portion 310 of the holding member 300, the contact portions 420 are arranged in the right-left direction, or in the first direction. The contact portions 420 are exposed on the plate-like portion 310 in the up-down direction perpendicular to both the front-rear direction and the right-left direction. In other words, the contact portions 420 are exposed on the plate-like portion 310 in the second direction perpendicular to both the predetermined direction and the first direction. The contact portions 420 of the contacts 400 are connected with the mating contacts 730, respectively, when the connector 100 is mated with the mating connector 700.

Figure 6:
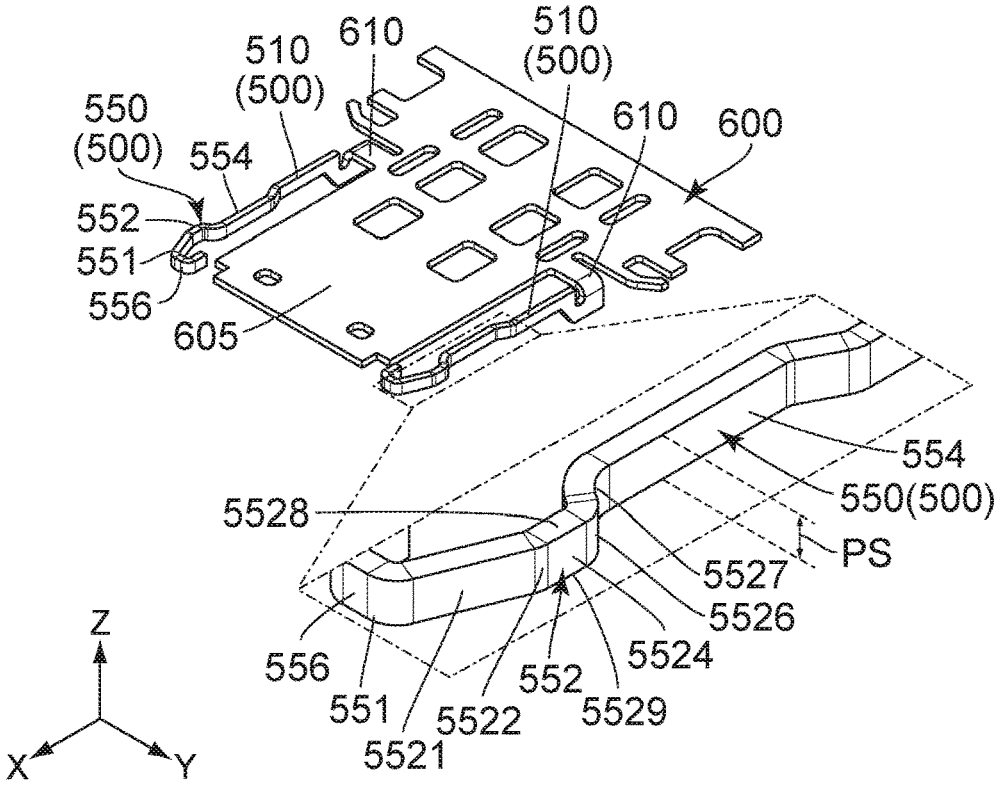
FIG. 6 is a perspective view showing a midplate and lock portions which are included in the connector main of FIG. 2. In the figure, a part of a spring portion is illustrated enlarged.

Referring to FIG. 6, the midplate 600 and the lock portions 500 are formed by punching out a single metal plate, followed by bending it.

Referring to FIGS. 2 and 5, the midplate 600 of the present embodiment is held by the holding member 300 so as to be positioned between the contact rows 450 in the up-down direction, or in the second direction. Specifically, the midplate 600 is incorporated into the holding member 300 through an insert-molding method upon molding of the holding member 300. Thus, the midplate 600 is embedded in the holding member 300.

As shown in FIG. 5, the midplate 600 of the present embodiment has a midplate main 605 and two coupling portions 610.

As shown in FIG. 6, the midplate main 605 of the present embodiment has a flat plate shape perpendicular to the up-down direction.

As shown in FIG. 6, the coupling portions 610 of the present embodiment are positioned at opposite end, respectively, of the midplate 600 in the right-left direction. Each of the coupling portions 610 extends outward in the right-left direction from the midplate main 605 and then extends downward in the up-down direction. The coupling portions 610 correspond to the lock portions 500, respectively. Each of the coupling portions 610 couples the midplate main 605 and the corresponding lock portion 500 with each other.

As shown in FIG. 2, the lock portions 500 of the present embodiment are positioned at opposite ends, respectively, of the plate-like portion 310 of the holding member 300 in the right-left direction. As shown in FIG. 5, each of the lock portions 500 of the present embodiment extends from the midplate 600 to be integrally formed with the midplate 600. Specifically, each of the lock portions 500 extends forward in the front-rear direction from a front end of the corresponding coupling portion 610 of the midplate 600.

As shown in FIG. 6, each of the lock portions 500 has a held portion 510 and a spring portion 550.

As shown in FIG. 5, the held portion 510 of the present embodiment is held by the holding member 300. Specifically, the held portion 510 is incorporated into the holding member 300 through an insert-molding method upon molding of the holding member 300. Thus, the held portion 510 is embedded in the holding member 300.

As shown in FIG. 6, the held portion 510 of each of the lock portions 500 extends forward in the front-rear direction, or in the predetermined direction, from the front end of the corresponding coupling portion 610 of the midplate 600. The held portion 510 defines a rear end of the lock portion 500 in the front-rear direction.

Figure 4:
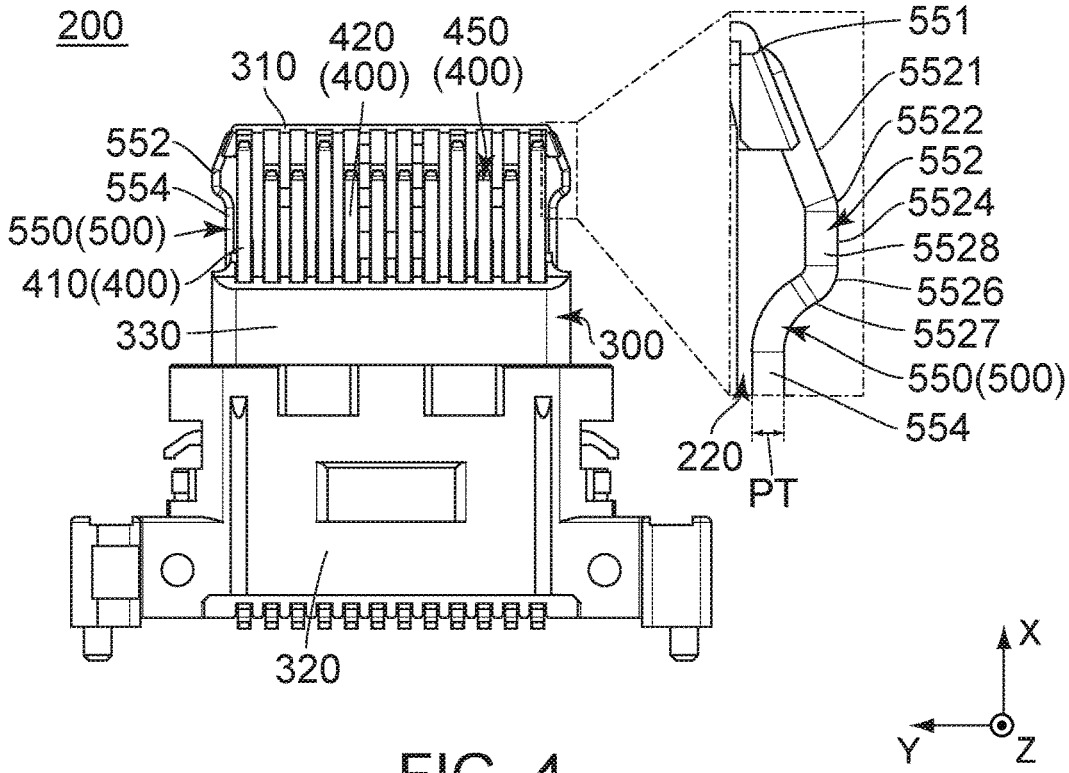
FIG. 4 is a top view showing the connector main of FIG. 2. In the figure, a part of the connector main is illustrated enlarged.

Referring to FIG. 6, the spring portion 550 of the present embodiment is resiliently deformable. The spring portion 550 extends from the held portion 510 in the front-rear direction, or in the predetermined direction. More specifically, the spring portion 550 extends forward from a front end of the held portion 510 in the front-rear direction. As shown in FIG. 4, the spring portion 550 has a predetermined thickness PT in a plane perpendicular to the up-down direction, or to the second direction. As shown in FIG. 6, the spring portion 550 has a predetermined size PS in the up-down direction, or in the second direction. Since the lock portion 500 is formed by punching out a single metal plate, followed by bending it as described above, the predetermined size PS is greater than the predetermined thickness PT.

As shown in FIG. 6, the spring portion 550 of the present embodiment has an end 551, a locking protrusion 552 and a resilient supporting portion 554.

As shown in FIG. 6, the end 551 of the present embodiment is a front end of the spring portion 550 in the front-rear direction.

As understood from FIGS. 4 and 9, the locking protrusion 552 and the mating lock portion 710 of the present embodiment are configured to lock a mated state where the connector 100 and the mating connector 700 are mated with each other. As shown in FIG. 6, the locking protrusion 552 protrudes outward in the right-left direction, or in the first direction. The locking protrusion 552 has a first slide surface 5521, a first bent portion 5522, a second slide surface (slide surface) 5524, a second bent portion 5526, a locking surface 5527, a first surface 5528 and a second surface 5529.

As shown in FIG. 6, the first slide surface 5521 of the present embodiment intersects with both the front-rear direction and the right-left direction. More specifically, the first slide surface 5521 extends forward in the front-rear direction and inward in the right-left direction. The first slide surface 5521 is a plane which faces forward in the front-rear direction and outward in the right-left direction. The first slide surface 5521 is positioned at a front end of the locking protrusion 552 in the front-rear direction.

As shown in FIG. 6, the first bent portion 5522 of the present embodiment couples the first slide surface 5521 and the second slide surface 5524 with each other. The first bent portion 5522 is coupled with a rear end of the first slide surface 5521. The first bent portion 5522 is coupled with a front end of the second slide surface 5524.

As shown in FIG. 6, the second slide surface (slide surface) 5524 of the present embodiment is a plane which faces outward in the right-left direction. The slide surface 5524 couples the first bent portion 5522 and the second bent portion 5526 with each other. The second slide surface 5524 is coupled with a rear end of the first bent portion 5522. The second slide surface 5524 is coupled with a front end of the second bent portion 5526.

As shown in FIG. 6, the second bent portion 5526 of the present embodiment couples the second slide surface 5524 and the locking surface 5527 with each other. The second bent portion 5526 is coupled with a rear end of the second slide surface 5524. The second bent portion 5526 is coupled with a front end of the locking surface 5527.

As shown in FIG. 6, the locking surface 5527 of the present embodiment is a curved surface which is concave rearward in the front-rear direction and outward in the right-left direction. The locking surface 5527 couples the second bent portion 5526 and the resilient supporting portion 554 with each other. The locking surface 5527 is coupled with a rear end of the second bent portion 5526. The locking surface 5527 is coupled with a front end of the resilient supporting portion 554. When the connector 100 and the mating connector 700 are mated with each other, the locking surface 5527 faces the mating lock surface 712 of the mating lock portion 710 in the front-rear direction, or in the predetermined direction, to lock the mated state of the connector 100 with the mating connector 700.

As described above, the lock portion 500 is formed by punching out a single metal plate, followed by bending it. Thus, each of the first slide surface 5521, the second slide surface 5524 and the locking surface 5527 is a smooth surface which is formed by roll forming. In other words, each of the first slide surface 5521, the second slide surface 5524 and the locking surface 5527 is not a rough, broken face.

As shown in FIG. 6, the first surface 5528 of the present embodiment defines an upper end of the locking protrusion 552 in the up-down direction. The first surface 5528 is a surface facing upward in the up-down direction.

Referring to FIG. 6, the second surface 5529 of the present embodiment defines a lower end of the locking protrusion 552 in the up-down direction. The second surface 5529 is a surface facing downward in the up-down direction.

As described above, the lock portion 500 is formed by punching out a single metal plate, followed by bending it. Thus, each of the first surface 5528 and the second surface 5529 of the present embodiment is a rough, broken face. In other words, each of the first surface 5528 and the second surface 5529 is not a smooth surface which is formed by roll forming.

As shown in FIG. 6, the resilient supporting portion 554 of the present embodiment supports the locking protrusion 552. The resilient supporting portion 554 couples the locking protrusion 552 and the held portion 510 with each other. The resilient supporting portion 554 extends rearward from a rear end of the locking protrusion 552. The resilient supporting portion 554 extends forward from the front end of the held portion 510.

As shown in FIG. 4, the connector main 200 has a space 220 which is positioned inward in the right-left direction, or in the first direction, beyond the spring portion 550. The space 220 allows resilient deformation of the spring portion 550. As understood from FIG. 4, the space 220 communicates with opposite outsides of the connector main 200 in the up-down direction, or in the second direction. The space 220 is, at least in part, visible when the connector main 200 is viewed along the up-down direction, or along the second direction. In other words, the space 220 communicates with the outside of the connector main 200 at both its upper side and lower side. The space 220 is, at least in part, visible when the connector main 200 is viewed from above in the up-down direction. Similarly, the space 220 is, at least in part, visible when the connector main 200 is viewed from below in the up-down direction.

As shown in FIG. 5, each of the lock portions 500 of the present embodiment further has an additional held portion 556 which is provided on the end 551 of the spring portion 550. The additional held portion 556 is held by the holding member 300. More specifically, the additional held portion 556 is held by the holding member 300 in the vicinity of a front end of the plate-like portion 310. The additional held portion 556 is incorporated into the holding member 300 through an insert-molding method upon molding of the holding member 300. Thus, the additional held portion 556 is embedded in the holding member 300. This prevents excessive deformation of the spring portion 550 even if the mating lock portion 710 of the mating connector 700 abuts against the end 551 of the spring portion 550 upon the mating of the connector 100 with the mating connector 700.

As shown in FIG. 1, the shell 650 of the present embodiment surrounds the connector main 200 in the plane perpendicular to the front-rear direction. The shell 650 is attached to the connector main 200. More specifically, the shell 650 is attached to the base portion 320 of the holding member 300 of the connector main 200. The shell 650 has an accommodation portion 652 which opens forward in the front-rear direction. The accommodation portion 652 accommodates the mating fitting portion 708 when the connector 100 and the mating connector 700 are mated with each other.

Second Embodiment

Figure 10:
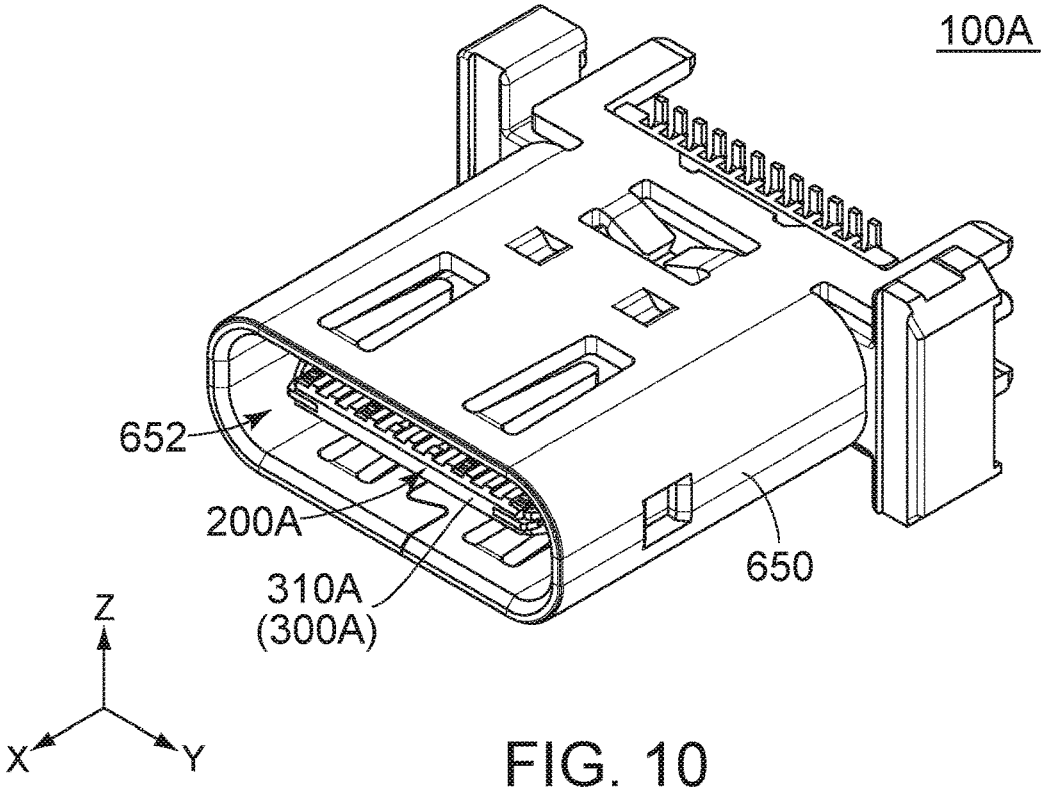
FIG. 10 is a perspective view showing a connector according to a second embodiment of the present invention.

As shown in FIG. 10, a connector 100A according to a second embodiment of the present invention is mateable with a mating connector (not shown) along the predetermined direction. The connector 100A according to the present embodiment has a structure similar to that of the connector 100 according to the aforementioned first embodiment as shown in FIG. 1. Components of the connector 100A shown in FIGS. 10 to 19 which are same as those of the connector 100 of the first embodiment are referred by using reference signs same as those of the connector 100 of the first embodiment. The mating connector of the present embodiment has a structure similar to that of the mating connector 700 according to the aforementioned first embodiment as shown in FIG. 7. Accordingly, a detailed explanation thereabout is omitted. As for directions and orientations in the present embodiment, expressions same as those of the first embodiment will be used hereinbelow.

As shown in FIG. 10, the connector 100A of the present embodiment has a connector main 200A and a shell 650. However, the present invention is not limited thereto. The connector 100A may be modified, provided that the connector 100A comprises at least the connector main 200A.

Figure 11:
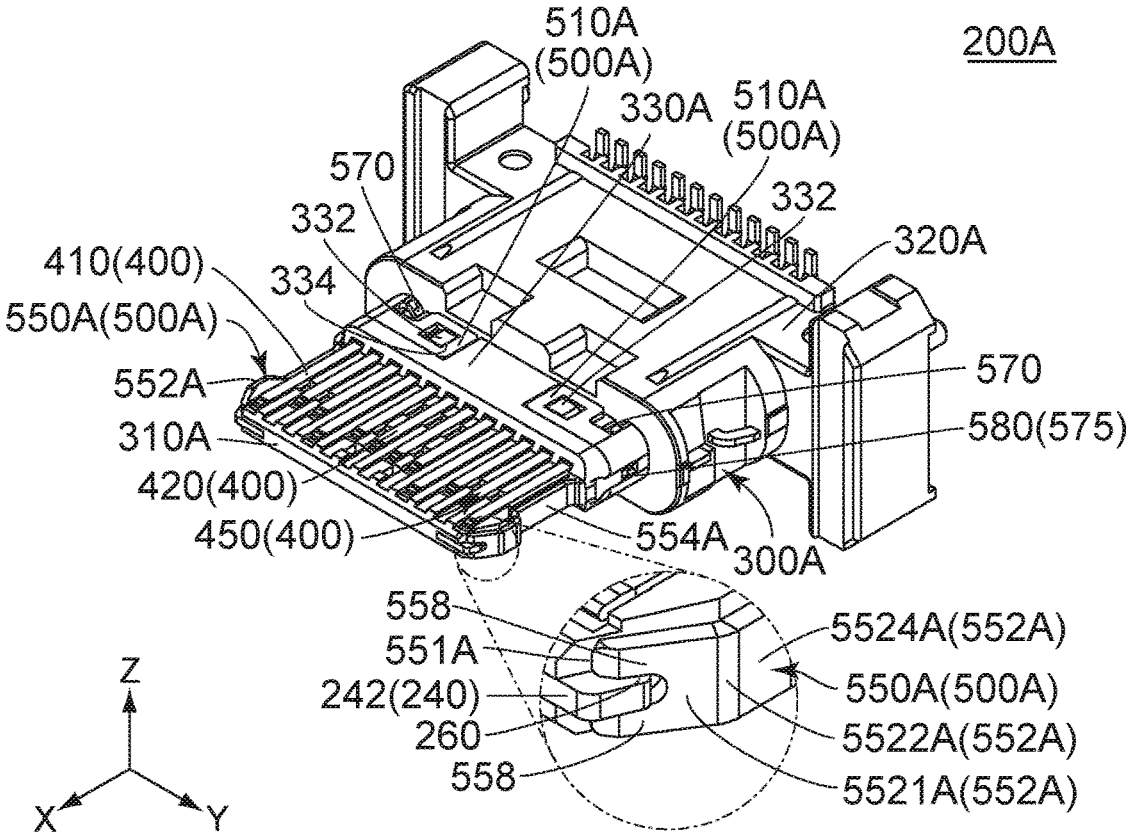
FIG. 11 is a perspective view showing a connector main which is included in the connector of FIG. 10. In the figure, a part of the connector main is illustrated enlarged.
Figure 12:
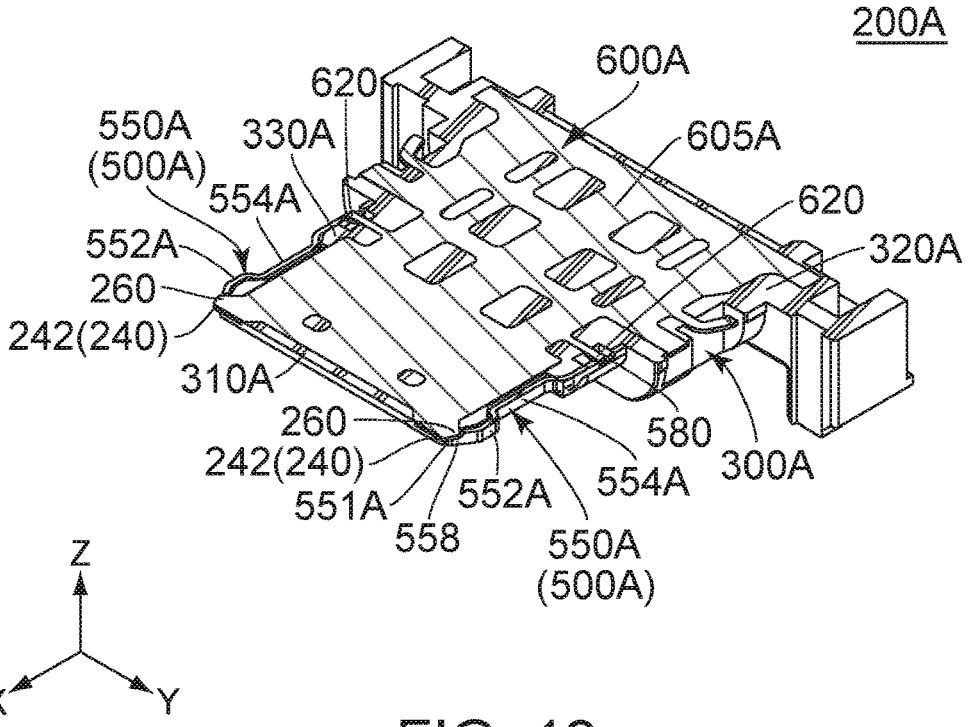
FIG. 12 is a perspective, cross-sectional view showing the connector main of FIG. 11.

As shown in FIGS. 11 and 12, the connector main 200A of the present embodiment comprises a holding member 300A, a plurality of contacts 400, a midplate 600A and two lock portions 500A. The contact 400 of the present embodiment has a structure same as that of the contact 400 of the first embodiment as shown in FIG. 2. Accordingly, a detailed explanation thereabout is omitted.

As shown in FIG. 11, the holding member 300A of the present embodiment has a plate-like portion 310A, a middle portion 330A and a base portion 320A. The base portion 320A of the present embodiment has a structure similar to that of the base portion 320 of the aforementioned first embodiment. Accordingly, a detailed explanation thereabout is omitted.

As shown in FIG. 11, the plate-like portion 310A of the present embodiment has a flat plate shape extending in a plane which is defined by the front-rear direction and the right-left direction. The plate-like portion 310A is accommodated in a mating accommodation portion (not shown) of the mating connector when the connector 100A is mated with the mating connector.

As shown in FIG. 11, the middle portion 330A of the present embodiment is positioned between the plate-like portion 310A and the base portion 320A in the front-rear direction, or in the predetermined direction. The middle portion 330A is positioned rearward of the plate-like portion 310A in the front-rear direction. The middle portion 330A is positioned forward of the base portion 320A in the front-rear direction. The middle portion 330A has an outer circumference which is greater than the plate-like portion 310A in a direction perpendicular to the front-rear direction. The middle portion 330A is accommodated in the mating accommodation portion when the connector 100A is mated with the mating connector.

Figure 13:
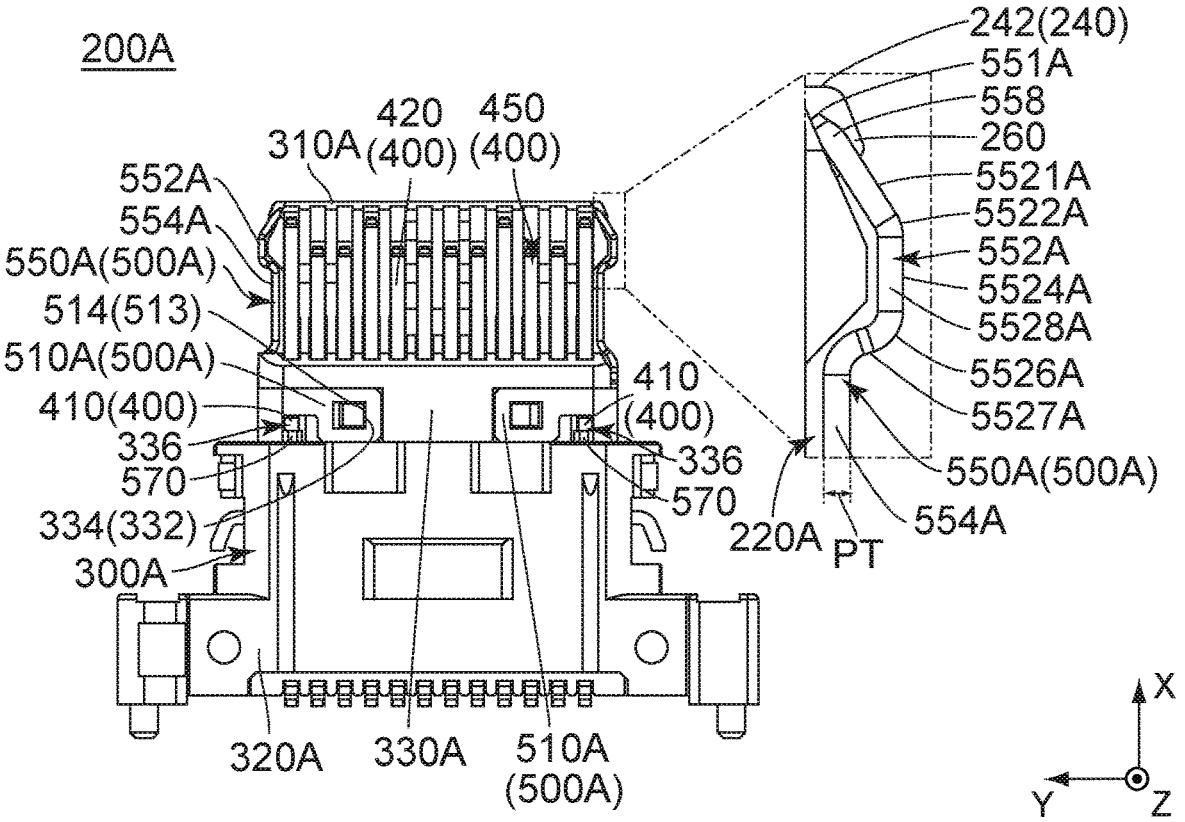
FIG. 13 is a top view showing the connector main of FIG. 11. In the figure, a part of the connector main is illustrated enlarged.

Referring to FIG. 13, the middle portion 330A of the present embodiment has four protruding portions 332 and four exposing holes 336.

Referring to FIG. 13, the four protruding portions 332 consist of two upper protruding portions 332 and two lower protruding portions 332. Each of the upper protruding portions 332 is positioned on an upper surface of the middle portion 330A. Each of the lower protruding portions 332 is positioned on a lower surface of the middle portion 330A. Each of the protruding portions 332 protrudes outward in the up-down direction. Each of the protruding portions 332 has a first facing portion 334. The first facing portion 334 is a surface facing inward in the right-left direction.

Referring to FIG. 13, the four exposing holes 336 consist of two upper exposing holes 336 and two lower exposing holes 336. Each of the upper exposing holes 336 is positioned on the upper surface of the middle portion 330A. Each of the lower exposing holes 336 is positioned on the lower surface of the middle portion 330A. When the connector main 200A is viewed along the up-down direction, a part of a ground terminal 410 is visible through the exposing hole 336. The part of the ground terminal 410 is exposed outside the middle portion 330A through the exposing hole 336.

Referring to FIG. 12, the midplate 600A of the present embodiment is formed by punching out a single metal plate, followed by bending it. The midplate 600A is distinct and separated from any of the lock portions 500A. The midplate 600A is made of material same as that of the lock portion 500A. However, the present invention is not limited thereto. The lock portion 500A may be made of material harder than other material of which the midplate 600A is made.

Referring to FIGS. 11 and 12, the midplate 600A of the present embodiment is held by the holding member 300A so as to be positioned between contact rows 450 in the up-down direction, or in the second direction. Specifically, the midplate 600A is incorporated into the holding member 300A through an insert-molding method upon molding of the holding member 300A. Accordingly, the midplate 600A is embedded in the holding member 300A.

As shown in FIG. 12, the midplate 600A of the present embodiment has a midplate main 605A and two connected portions 620.

As shown in FIG. 12, the midplate main 605A of the present embodiment has a flat plate shape perpendicular to the up-down direction.

As shown in FIG. 12, the connected portions 620 of the present embodiment are positioned at opposite ends, respectively, of the midplate 600A in the right-left direction. Each of the connected portions 620 extends outward in the right-left direction from the midplate main 605A. Each of the connected portions 620 has a flat plate shape perpendicular to the up-down direction. An outer end of the connected portion 620 in the right-left direction is exposed outside the middle portion 330A of the holding member 300A.

Figure 14:
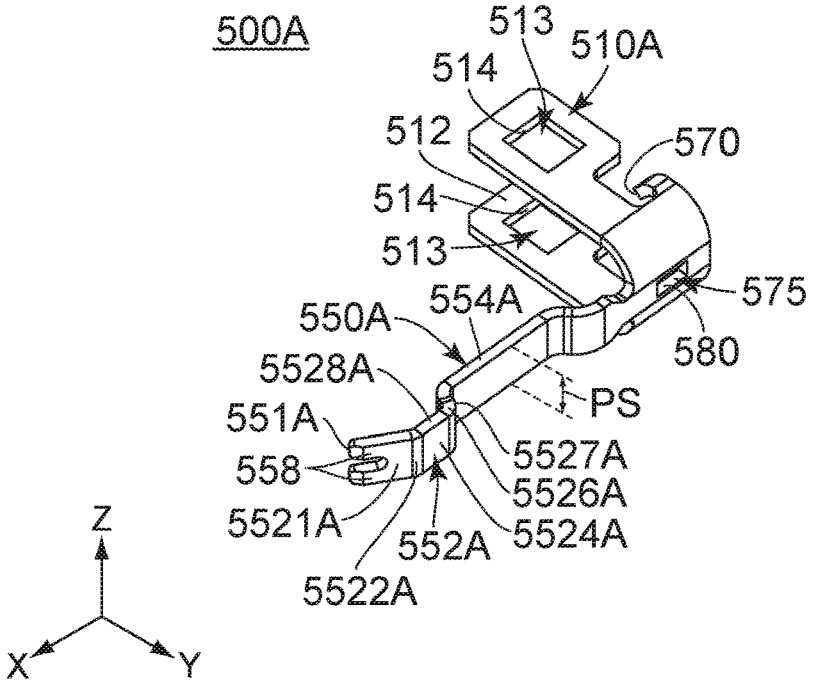
FIG. 14 is a perspective view showing one of lock portions which are included in the connector main of FIG. 11.

Referring to FIG. 14, each of the lock portions 500A of the present embodiment is formed by punching out a single metal plate, followed by bending it. Although the lock portion 500A of the present embodiment is made of material same as that of the midplate 600A as described above, the present invention is not limited thereto. The lock portion 500A may be made of material harder than other material of which the midplate 600A is made.

As shown in FIG. 13, the lock portions 500A of the present embodiment are positioned at opposite ends, respectively, of the plate-like portion 310A of the holding member 300A in the right-left direction. As shown in FIG. 14, each of the lock portions 500A has a held portion 510A, a spring portion 550A, a connection portion 570 and a connected portion accommodating portion 575.

Figure 15:
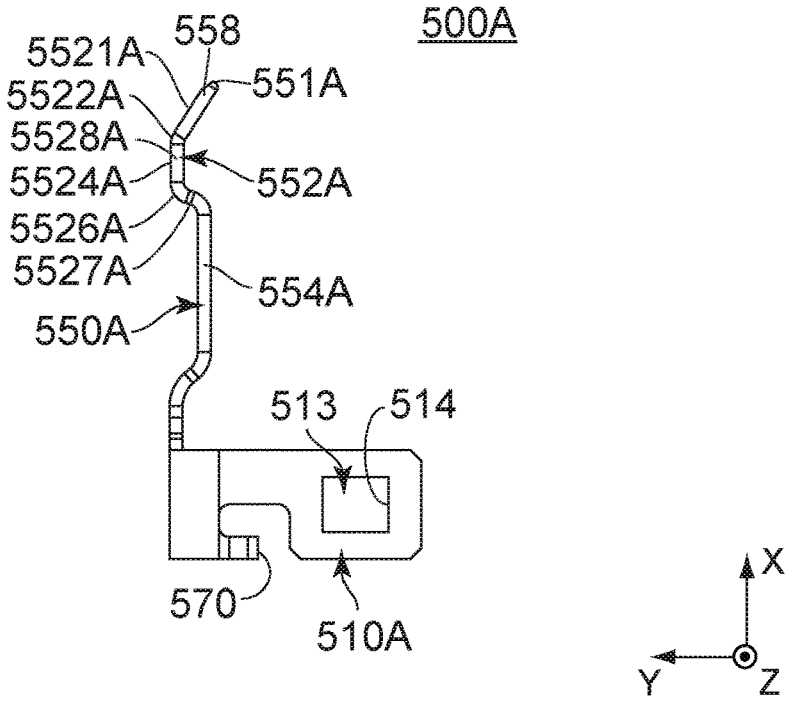
FIG. 15 is a top view showing the lock portion of FIG. 14.
Figure 18:
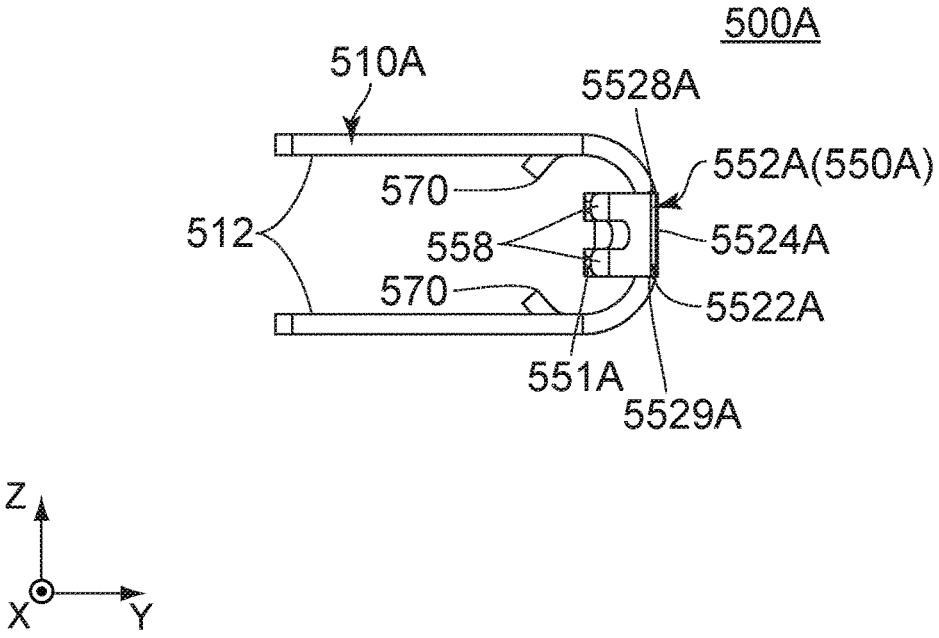
FIG. 18 is a front view showing the lock portion of FIG. 14.
Figure 19:
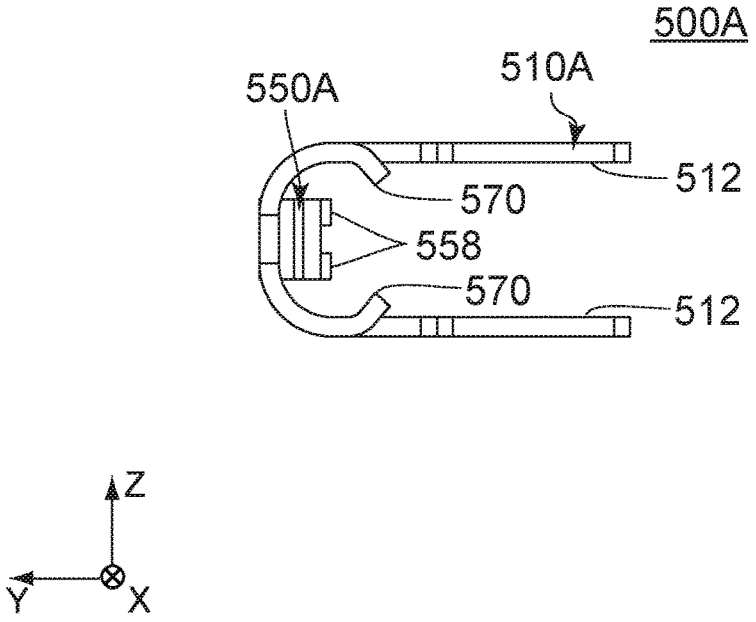
FIG. 19 is a rear view showing the lock portion of FIG. 14.
Figure 20:
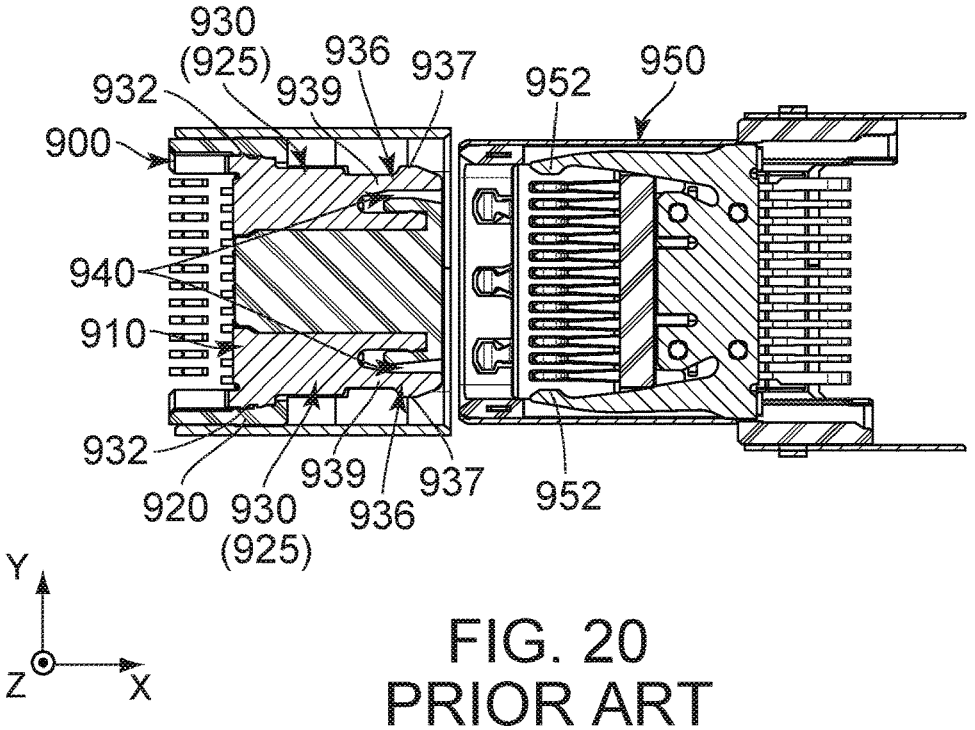
FIG. 20 PRIOR ART
FIG. 20 is a cross-sectional view showing a connector and a mating connector of Patent Document 1. In the figure, the connector and the mating connector are not mated with each other.
Figure 21:
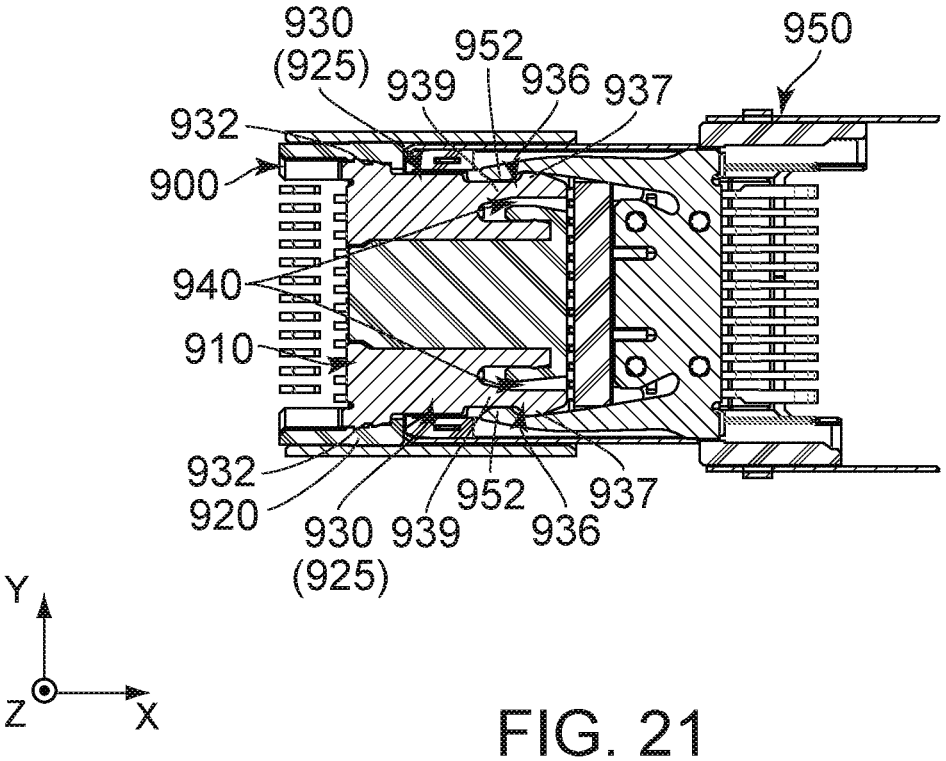
FIG. 21 PRIOR ART
FIG. 21 is another cross-sectional view showing the connector and the mating connector of FIG. 20. In the figure, the connector and the mating connector are mated with each other.

As shown in FIG. 18, the held portion 510A of the present embodiment extends inward in the right-left direction, or in the first direction. The held portion 510A has a sideways U-shape when viewed along the front-rear direction, or along the predetermined direction. As shown in FIG. 15, the held portion 510A defines a rear end of the lock portion 500A in the front-rear direction.

As shown in FIGS. 14 and 18, the held portion 510A has two press portions 512 and two protruding portion accommodating portions 513. The two press portions 512 are spaced apart from each other in the up-down direction. The two protruding portion accommodating portions 513 are spaced apart from each other in the up-down direction. Each of the protruding portion accommodating portions 513 is a hole which pierces the held portion 510A in the up-down direction. Each of the protruding portion accommodating portions 513 has a second facing portion 514. The second facing portion 514 is a surface facing outward in the right-left direction.

As shown in FIG. 13, the held portion 510A is held by the holding member 300A. Specifically, the lock portion 500A is held by the holding member 300A only at the held portion 510A. The press portion 512, which is positioned at an upper side of the held portion 510A, pushes the upper surface of the middle portion 330A of the holding member 300A downward. The press portion 512, which is positioned at a lower side of the held portion 510A, pushes the lower surface of the middle portion 330A of the holding member 300A upward. The protruding portion accommodating portion 513, which is positioned at the upper side of the held portion 510A, accommodates one of the two upper protruding portions 332. Similarly, the protruding portion accommodating portion 513, which is positioned at the lower side of the held portion 510A, accommodates one of the two lower protruding portions 332. The second facing portion 514, which is positioned at the upper side of the held portion 510A, faces the first facing portion 334 of the one of the upper protruding portions 332 in the right-left direction. Similarly, the second facing portion 514, which is positioned at the lower side of the held portion 510A, faces the first facing portion 334 of the one of the lower protruding portions 332 in the right-left direction.

Referring to FIGS. 9 and 13, when the connector 100A is mated with the mating connector, the held portion 510A of the present embodiment is brought into contact with a ground spring (not shown) of the mating connector to form a ground plane.

Referring to FIG. 14, the spring portion 550A of the present embodiment is resiliently deformable. The spring portion 550A extends from the held portion 510A in the front-rear direction, or in the predetermined direction. More specifically, the spring portion 550A extends forward in the front-rear direction from a front end of the held portion 510A. As shown in FIG. 13, the spring portion 550A has a predetermined thickness PT in a plane perpendicular to the up-down direction, or to the second direction. As shown in FIG. 14, the spring portion 550A has a predetermined size PS in the up-down direction, or in the second direction. Since the lock portion 500A is formed by punching out a single metal plate, followed by bending it as described above, the predetermined size PS is greater than the predetermined thickness PT.

As shown in FIG. 14, the spring portion 550A of the present embodiment has an end 551A, a locking protrusion 552A and a resilient supporting portion 554A.

As shown in FIG. 14, the end 551A of the present embodiment is a front end of the spring portion 550A in the front-rear direction.

As understood from FIGS. 9 and 13, the locking protrusion 552A and a mating lock portion (not shown) of the mating connector of the present embodiment are configured to lock a mated state where the connector 100A is mated with the mating connector. The locking protrusion 552A protrudes outward in the right-left direction, or in the first direction. The locking protrusion 552A has a first slide surface 5521A, a first bent portion 5522A, a second slide surface (slide surface) 5524A, a second bent portion 5526A, a locking surface 5527A, a first surface 5528A and a second surface 5529A.

As shown in FIG. 13, the first slide surface 5521A of the present embodiment intersects with both the front-rear direction and the right-left direction. More specifically, the first slide surface 5521A extends forward in the front-rear direction and inward in the right-left direction. The first slide surface 5521A is a plane which faces forward in the front-rear direction and outward in the right-left direction. The first slide surface 5521A is positioned at a front end of the locking protrusion 552A in the front-rear direction.

As shown in FIG. 13, the first bent portion 5522A of the present embodiment couples the first slide surface 5521A and the second slide surface 5524A with each other. The first bent portion 5522A is coupled with a rear end of the first slide surface 5521A. The first bent portion 5522A is coupled with a front end of the second slide surface 5524A.

As shown in FIG. 13, the second slide surface (slide surface) 5524A of the present embodiment is a plane which faces outward in the right-left direction. The slide surface 5524A couples the first bent portion 5522A and the second bent portion 5526A with each other in the front-rear direction, or in the predetermined direction. The second slide surface 5524A is coupled with a rear end of the first bent portion 5522A. The second slide surface 5524A is coupled with a front end of the second bent portion 5526A.

As shown in FIG. 13, the second bent portion 5526A of the present embodiment couples the second slide surface 5524A and the locking surface 5527A with each other. The second bent portion 5526A is coupled with a rear end of the second slide surface 5524A. The second bent portion 5526A is coupled with a front end of the locking surface 5527A.

As shown in FIG. 13, the locking surface 5527A of the present embodiment is a curved surface which is concave rearward in the front-rear direction and outward in the right-left direction. The locking surface 5527A couples the second bent portion 5526A and the resilient supporting portion 554A with each other. The locking surface 5527A is coupled with a rear end of the second bent portion 5526A. The locking surface 5527A is coupled with a front end of the resilient supporting portion 554A. When the connector 100A and the mating connector are mated with each other, the locking surface 5527A faces a mating lock surface (not shown) of the mating lock portion in the front-rear direction, or in the predetermined direction, to lock the mated state of the connector 100A with the mating connector.

As described above, the lock portion 500A is formed by punching out a single metal plate, followed by bending it. Thus, each of the first slide surface 5521A, the second slide surface 5524A and the locking surface 5527A of the present embodiment is a smooth surface which is formed by roll forming. In other words, each of the first slide surface 5521A, the second slide surface 5524A and the locking surface 5527A of the present embodiment is not a rough, broken face.

As shown in FIG. 18, the first surface 5528A of the present embodiment defines an upper end of the locking protrusion 552A in the up-down direction. The first surface 5528A is a surface facing upward in the up-down direction.

As shown in FIG. 18, the second surface 5529A of the present embodiment defines a lower end of the locking protrusion 552A in the up-down direction. The second surface 5529A is a surface facing downward in the up-down direction.

As described above, the lock portion 500A is formed by punching out a single metal plate, followed by bending it. Thus, each of the first surface 5528A and the second surface 5529A of the present embodiment is a rough, broken face. In other words, each of the first surface 5528A and the second surface 5529A of the present embodiment is not a smooth surface which is formed by roll forming.

As shown in FIG. 15, the resilient supporting portion 554A of the present embodiment supports the locking protrusion 552A. The resilient supporting portion 554A couples the locking protrusion 552A and the held portion 510A with each other. The resilient supporting portion 554A extends rearward from a rear end of the locking protrusion 552A. The resilient supporting portion 554A extends forward from the front end of the held portion 510A.

As shown in FIG. 13, the connector main 200A has a space 220A which is positioned inward in the right-left direction, or in the first direction, beyond the spring portion 550A. The space 220A allows resilient deformation of the spring portion 550A. As understood from FIG. 13, the space 220A communicates with opposite outsides of the connector main 200A in the up-down direction, or in the second direction. The space 220A is, at least in part, visible when the connector main 200A is viewed along the up-down direction, or along the second direction. In other words, the space 220A communicates with the outside of the connector main 200A at both its upper side and lower side. The space 220A is, at least in part, visible when the connector main 200A is viewed from above along the up-down direction. Similarly, the space 220A is, at least in part, visible when the connector main 200A is viewed from below along the up-down direction.

As shown in FIG. 15, the connection portion 570 of the present embodiment is provided on the held portion 510A. The connection portion 570 is positioned at the rear end of the lock portion 500A. The connection portion 570 extends inward in the right-left direction, or in the first direction. As shown in FIG. 13, the connection portion 570 is connected with the ground terminal 410. More specifically, the connection portion 570 is connected with the part of the ground terminal 410 which is exposed outside the middle portion 330A of the holding member 300A through the exposing hole 336.

Figure 16:
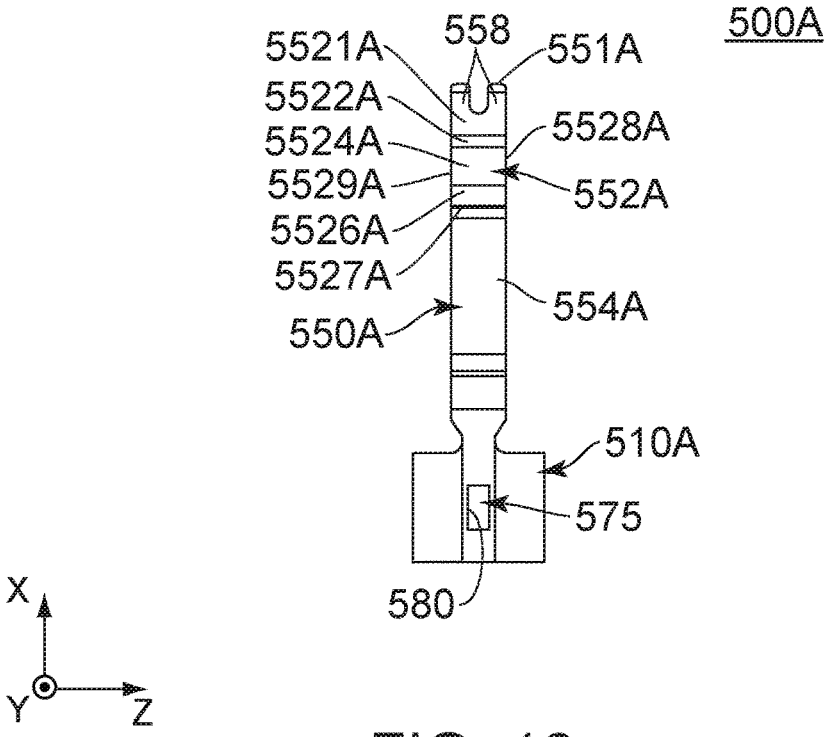
FIG. 16 is an outer side view showing the lock portion of FIG. 14.
Figure 17:
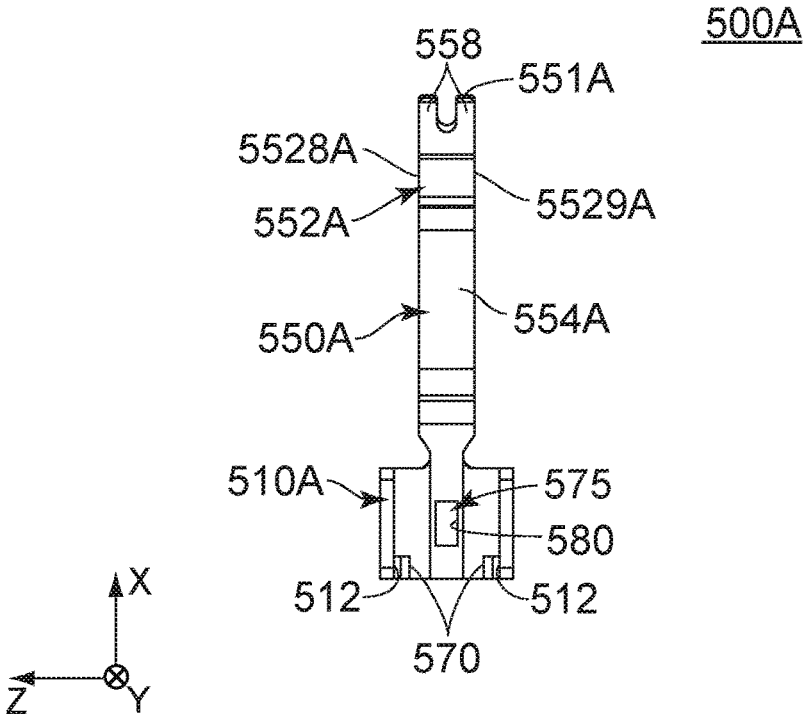
FIG. 17 is an inner side view showing the lock portion of FIG. 14.

As shown in FIG. 16, the connected portion accommodating portion 575 of the present embodiment is a hole which pierces the held portion 510A in the right-left direction. The connected portion accommodating portion 575 has an additional connection portion 580 at its lower end.

As shown in FIG. 16, the additional connection portion 580 of the present embodiment is positioned around the rear end of the lock portion 500A. As shown in FIG. 14, the additional connection portion 580 is a surface facing upward in the up-down direction. As shown in FIG. 12, the additional connection portion 580 is connected with the midplate 600A. More specifically, the additional connection portions 580 of the two lock portions 500A are connected with the outer ends of the two connected portions 620, respectively, of the midplate 600A in the right-left direction.

As shown in FIG. 16, the end 551A of the spring portion 550A of the present embodiment is provided with a regulated portion 558 which is branched into two sections. More specifically, the regulated portion 558 is branched into the two sections which are arranged in the up-down direction, or in the second direction.

As shown in FIGS. 11 and 12, the connector main 200A of the present embodiment further comprises guard portions 240. The guard portions 240 guard the ends 551A of the spring portions 550A of the two lock portions 500A, respectively.

As shown in FIGS. 11 and 12, each of the guard portions 240 of the present embodiment is held by the holding member 300A. More specifically, each of the guard portions 240 is held by a front end of the plate-like portion 310A of the holding member 300A. Each of the guard portions 240 is incorporated into the holding member 300A through an insert-molding method upon molding of the holding member 300A. Accordingly, a part of each of the guard portions 240 is embedded in the holding member 300A.

As shown in FIG. 12, each of the guard portions 240 is formed integrally with the midplate 600A. However, the present invention is not limited thereto. The guard portion 240 may be distinct and separated from the midplate 600A.

As shown in FIG. 11, the guard portion 240 has an end 242 in the front-rear direction, or in the predetermined direction. The end 242 is a front end of the guard portion 240 in the front-rear direction. The end 551A of the spring portion 550A is positioned between the end 242 of the guard portion 240 and the held portion 510A in the front-rear direction, or in the predetermined direction. The end 551A of the spring portion 550A is positioned between the end 242 of the guard portion 240 and the first bent portion 5522A in the front-rear direction.

As shown in FIGS. 11 and 12, the connector main 200A of the present embodiment further comprises regulating portions 260.

As shown in FIGS. 11 and 12, each of the regulating portions 260 of the present embodiment is held by the holding member 300A. More specifically, each of the regulating portions 260 is held by the holding member 300A in the vicinity of the front end of the plate-like portion 310A. Each of the regulating portions 260 is incorporated into the holding member 300A through an insert-molding method upon molding of the holding member 300A. Thus, a part of each of the regulating portions 260 is embedded in the holding member 300A.

As shown in FIG. 12, each of the regulating portions 260 is formed integrally with the midplate 600A. In other words, the midplate 600A, the guard portions 240 and the regulating portions 260 of the present embodiment are formed integrally with one another. However, the present invention is not limited thereto. The regulating portion 260 may be distinct and separated from any of the midplate 600A and the guard portions 240.

As shown in FIG. 11, the regulating portion 260 is sandwiched by the two sections of the regulated portion 558 in the up-down direction, or in the second direction. This regulates a movement of the end 551A of the spring portion 550A in the up-down direction, or in the second direction. In other words, the regulating portion 260 regulates the movement of the end 551A of the spring portion 550A in the up-down direction, or in the second direction. This regulation prevents buckling of the spring portion 550A when the lock portion 500A is brought into contact with the mating lock portion. In addition, this regulation prevents accidental deformation of the spring portion 550A in the up-down direction.

As shown in FIG. 10, the shell 650 of the present embodiment partially surrounds the connector main 200A in a plane perpendicular to the front-rear direction. The shell 650 is attached to the connector main 200A. More specifically, the shell 650 is attached to the base portion 320A of the holding member 300A of the connector main 200A. The shell 650 has an accommodation portion 652 which opens forward in the front-rear direction. The accommodation portion 652 accommodates a mating fitting portion (not shown) of the mating connector when the connector 100A and the mating connector are mated with each other.

Although the specific explanation about the present invention is made above referring to the embodiments, the present invention is not limited thereto and is susceptible to various modifications and alternative forms.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a predetermined direction, wherein:

the mating connector comprises a mating lock portion;

the connector comprises at least a connector main;

the connector main comprises a holding member, a plurality of contacts, and two lock portions;

the holding member has a plate-like portion;

the contacts are held by the holding member;

each of the contacts has a contact portion;

on the plate-like portion, the contact portions are arranged in a first direction perpendicular to the predetermined direction;

the contact portions are exposed on the plate-like portion in a second direction perpendicular to both the predetermined direction and the first direction;

each of the lock portions has a held portion and a spring portion;

the held portion is held by the holding member;

the spring portion is resiliently deformable;

the spring portion extends from the held portion in the predetermined direction;

the spring portion has a predetermined size in the second direction;

the spring portion has a predetermined thickness in a plane perpendicular to the second direction;

the predetermined size is greater than the predetermined thickness;

the spring portion has a locking protrusion and a resilient supporting portion;

the locking protrusion protrudes outward in the first direction;

the locking protrusion and the mating lock portion lock a mated state where the connector and the mating connector are mated with each other;

the resilient supporting portion supports the locking protrusion;

the connector main has a space which is positioned inward in the first direction beyond the spring portion;

the space allows resilient deformation of the spring portion;

the space communicates with opposite outsides of the connector main in the second direction;

the space is, at least in part, visible when the connector main is viewed along the second direction; and the space extends from a location just adjacent to the resilient supporting portion and extends to a location just adjacent to the locking protrusion.

2. The connector as recited in claim 1, wherein:

the spring portion has an end in the predetermined direction;

each of the lock portions further has an additional held portion which is provided on the end of the spring portion; and the additional held portion is held by the holding member.

3. The connector as recited in claim 1, wherein:

the connector main further comprises a midplate;

the contacts form two contact rows;

the contacts of each of the contact rows are arranged in the first direction;

the contact rows are arranged apart from each other in the second direction;

the midplate is held by the holding member so as to be positioned between the contact rows in the second direction; and each of the lock portions extends from the midplate and is integrally formed with the midplate.

4. The connector as recited in claim 1, wherein each of the lock portions is held by the holding member only at the held portion.

5. The connector as recited in claim 4, wherein:

the spring portion has an end in the predetermined direction;

the connector main further comprises a guard portion which guards the end of the spring portion;

the guard portion is held by the holding member;

the guard portion has an end in the predetermined direction; and the end of the spring portion is positioned between the end of the guard portion and the held portion in the predetermined direction.

6. The connector as recited in claim 4, wherein:

the connector main further comprises a regulating portion;

the regulating portion is held by the holding member;

the spring portion has an end in the predetermined direction; and the regulating portion regulates a movement of the end of the spring portion in the second direction.

7. The connector as recited in claim 6, wherein:

the end of the spring portion is provided with a regulated portion which is branched into two sections; and the regulating portion is sandwiched by the two sections of the regulated portion in the second direction.

8. The connector as recited in claim 4, wherein:

the plurality of contacts include at least one ground terminal;

the lock portion has a connection portion; and the connection portion is connected with the at least one ground terminal.

9. The connector as recited in claim 4, wherein:

the connector main further comprises a midplate;

the contacts form two contact rows;

the contacts of each of the contact rows are arranged in the first direction;

the contact rows are arranged apart from each other in the second direction;

the midplate is held by the holding member so as to be positioned between the contact rows in the second direction;

the midplate is distinct and separated from any of the lock portions;

each of the lock portions has an additional connection portion; and the additional connection portion is connected with the midplate.

10. The connector as recited in claim 1, wherein:

the locking protrusion has a first bent portion, a slide surface, and a second bent portion; and the slide surface couples the first bent portion and the second bent portion with each other in the predetermined direction.

11. A connector mateable with a mating connector along a predetermined direction, wherein:

the mating connector comprises a mating lock portion;

the connector comprises at least a connector main;

the connector main comprises a holding member, a plurality of contacts, and two lock portions;

the holding member has a plate-like portion;

the contacts are held by the holding member;

each of the contacts has a contact portion;

on the plate-like portion, the contact portions are arranged in a first direction perpendicular to the predetermined direction;

the contact portions are exposed on the plate-like portion in a second direction perpendicular to both the predetermined direction and the first direction;

each of the lock portions has a held portion and a spring portion;

the held portion is held by the holding member;

the spring portion is resiliently deformable;

the spring portion extends from the held portion in the predetermined direction;

the spring portion has a predetermined size in the second direction;

the spring portion has a predetermined thickness in a plane perpendicular to the second direction;

the predetermined size is greater than the predetermined thickness;

the spring portion has a locking protrusion and a resilient supporting portion;

the locking protrusion protrudes outward in the first direction;

the locking protrusion and the mating lock portion lock a mated state where the connector and the mating connector are mated with each other;

the resilient supporting portion supports the locking protrusion;

the connector main has a space which is positioned inward in the first direction beyond the spring portion;

the space allows resilient deformation of the spring portion, each of the lock portions is held by the holding member only at the held portion;

the spring portion has an end in the predetermined direction;

the connector main further comprises a guard portion which guards the end of the spring portion;

the guard portion is held by the holding member;

the guard portion has an end in the predetermined direction; and the end of the spring portion is positioned between the end of the guard portion and the held portion in the predetermined direction.

12. A connector mateable with a mating connector along a predetermined direction, wherein:

the mating connector comprises a mating lock portion;

the connector comprises at least a connector main;

the connector main comprises a holding member, a plurality of contacts, and two lock portions;

the holding member has a plate-like portion;

the contacts are held by the holding member;

each of the contacts has a contact portion;

on the plate-like portion, the contact portions are arranged in a first direction perpendicular to the predetermined direction;

the contact portions are exposed on the plate-like portion in a second direction perpendicular to both the predetermined direction and the first direction;

each of the lock portions has a held portion and a spring portion;

the held portion is held by the holding member;

the spring portion is resiliently deformable;

the spring portion extends from the held portion in the predetermined direction;

the spring portion has a predetermined size in the second direction;

the spring portion has a predetermined thickness in a plane perpendicular to the second direction;

the predetermined size is greater than the predetermined thickness;

the spring portion has a locking protrusion and a resilient supporting portion;

the locking protrusion protrudes outward in the first direction;

the locking protrusion and the mating lock portion lock a mated state where the connector and the mating connector are mated with each other;

the resilient supporting portion supports the locking protrusion;

the connector main has a space which is positioned inward in the first direction beyond the spring portion;

the space allows resilient deformation of the spring portion, each of the lock portions is held by the holding member only at the held portion;

the connector main further comprises a regulating portion;

the regulating portion is held by the holding member;

the spring portion has an end in the predetermined direction; and the regulating portion regulates a movement of the end of the spring portion in the second direction.

13. The connector as recited in claim 12, wherein:

the end of the spring portion is provided with a regulated portion which is branched into two sections; and the regulating portion is sandwiched by the two sections of the regulated portion in the second direction.

* * * * *